US005608803A

United States Patent [19]

Magotra et al.

[11] Patent Number: 5,608,803

[45] Date of Patent: Mar. 4, 1997

[54] PROGRAMMABLE DIGITAL HEARING AID

[75] Inventors: Neeraj Magotra, Albuquerque, N.M.; T. Raj Natarajan, Plano, Tex.; Frank Livingston; Sarala R. Gopalan, both of Albuquerque, N.M.

[73] Assignee: The University of New Mexico, Albuquerque, N.M.

[21] Appl. No.: 442,626

[22] Filed: May 17, 1995

Related U.S. Application Data

[63] Continuation of Ser. No. 102,364, Aug. 5, 1993, abandoned.

[51] Int. Cl.[6] ..... H04R 25/00

[52] U.S. Cl. ..... 381/68.2; 381/68; 381/68.4

[58] Field of Search ..... 381/68, 68.1, 68.2, 381/68.4; 128/746

[56] References Cited

U.S. PATENT DOCUMENTS

| | | | |
|---|---|---|---|
| 4,025,721 | 5/1977 | Graupe et al. | 381/68.2 |
| 4,548,082 | 10/1985 | Engebretson et al. | 381/68.6 |
| 4,731,850 | 3/1988 | Levitt et al. . | |
| 4,879,749 | 11/1989 | Levitt et al. . | |
| 4,887,299 | 12/1989 | Cummins et al. . | |
| 4,926,159 | 5/1990 | Bartlett . | |
| 4,947,432 | 8/1990 | T pholm . | |
| 4,947,433 | 8/1990 | Gebert . | |
| 4,989,251 | 1/1991 | Mangold . | |
| 5,007,090 | 4/1991 | Bransky et al. . | |
| 5,014,318 | 5/1991 | Schott et al. . | |
| 5,027,410 | 6/1991 | Williamson et al. | 381/68.4 |
| 5,083,312 | 1/1992 | Newton et al. . | |
| 5,226,086 | 7/1993 | Platt . | |

*Primary Examiner*—Sinh Tran
*Attorney, Agent, or Firm*—Mitchell B. Wasson

[57] ABSTRACT

A programmable customized universal digital listening system is provided with one or more digital signal processor chips which are implemented as one or more digital filters whose parameters are established by one or more erasable programmable read-only memories (EPROMs). The information included in the EPROMs directed to the parameters of the digital filters are determined based upon the user's response to various audio signals provided from an audiologist. Based upon these responses, the EPROMs are programmed. Additionally, this listening system is provided with an additional digital filter which changes its responses based upon the frequency of any background noise.

14 Claims, 6 Drawing Sheets

PROGRAMMABLE DIGITAL HEARING AID

This is a continuation of application Ser. No. 08/102,364 filed on Aug. 5, 1993, now abandoned.

BACKGROUND OF THE INVENTION

1. Field of the Invention

The present invention relates to a digital binaural hearing aid employing a digital signal processing chip programmed in part utilizing an erasable programmable read only memory (EPROM) provided in the hearing aid.

2. Brief Statement of the Prior Art

The need to improve the hearing of an individual has been looked upon as a worthwhile goal for many years. The first "hearing aids" merely consisted of an individual cupping his or her hand behind their ear or utilizing an ear trumpet to focus audio waves onto the person's ear drum. These rudimentary hearing aids were replaced by heating aids which merely electrically amplified the audio waves.

Although these types of "amplified" heating aids did improve the user's hearing to some degree, it was determined that the user's inability to adequately hear was not just a function of the strength of the signal received by the ear, but was also a function of the inability of the user to discern spoken words in the presence of background noise. Consequently, the next stage of hearing aids employed one or more analog filters which were designed to filter out background or extraneous noise.

Additional improvements to these types of heating aids resulted in programmable devices which were implemented utilizing analog circuits and analog signal processing. Examples of these types of hearing aids are shown in U.S. Pat. Nos. 4,947,432, issued to T phlom; 4,947,433, issued to Gebert; 4,989,251, issued to Mangold; and 5,083,312, issued to Newton et al. Further improvements are described in U.S. Pat. Nos. 4,731,850 and 4,879,749, issued to Levitt et al, and 4,887,299, issued to Cummins et al, which describes hearing aids including digital signal processing. However, none of these references describe a programmable hearing aid which would include a large number of filters provided over a relatively large frequency band.

SUMMARY OF THE INVENTION

The present invention overcomes the deficiencies of the prior art by providing a customized universal digital listening system (CUDLS) which provides binaural phonetic speech equalization and exhibits a great deal of design flexibility. The CUDLS unit can be reprogrammed for many different languages such as English, Spanish, Navaho, Zuni, Hindi, etc. This is true since the implementation of the hearing aid of the present invention is based on the acoustic phonetics of a given language rather than the octave bands of the language. Research in this area by Professor Djordje Kostic has shown that utilizing his Kostic selective auditory frequency amplifier (KSAFA), young elementary school deaf children showed significantly better phoneme acquisition and improved articulation. The programmability of the present invention is implemented utilizing one or more digital signal processor chips which are programmed by one or more EPROMs. Each of the digital signal processing chips can implement an unlimited number of digital filters forming a composite filter having a bandwidth of approximately 0–9 KHz. This bandwidth is contrasted with a bandwidth in a frequency range of 100 Hz to 4400 Hz in which most commercially available hearing aids and analog devices typically amplify speech. Furthermore, the present invention could also assist persons with hyperacoustic problems since not only can specific frequency ranges be amplified, the frequency ranges that cause problem to specific users can be totally suppressed.

The CUDLS system uniquely programs each of the digital signal processor chips based upon the user's own specific needs. This is accomplished by allowing an audiologist to perform binaural equalization, tone generation, spectral analysis, calibration and hearing aid testing on each individual user by employing a personal computer. Based upon the responses elicited by the user, the audiologist would be able to determine the number of digital filters to be utilized as well as to program each of these digital filters included in each of the digital signal processor chips. The audiologist would do this by designating the particular bandwidth of each of the digital filters as well as setting the gain of each of these filters based upon the unique needs of each of the individuals. As previously indicated, the audiologist could also suppress particular frequency ranges. Once the number of filters to be utilized is decided by the audiologist, the frequency band of each filter as well as the gain of each filter is determined. This information is downloaded into one or more of the EPROMs included in the hearing aid. When the heating aid is activated, this information would be used to implement the proper settings of the digital filters included in the digital signal processor chip. At this point, once these settings have been transmitted to the digital signal processor chip, the filters included thereon would act as a composite filter.

The CUDLS is also provided with an environmentally conditioned filter for eliminating background or other noise which would interfere in the ability of the user to hear and understand speech. This feature of the CUDLS is implemented utilizing an additional filter for eliminating unwanted noise and is used in conjunction with the composite filter implemented by the digital signal processor chips.

In operation, after the heating aid has been programmed and has been activated, analog audio information is converted to a digital signal which is processed by the digital signal processor chip. This audio information which is now in digital form is then converted back to an analog signal which is transmitted to the user's earphone.

DESCRIPTION OF THE PREFERRED EMBODIMENT

For a better understanding of the invention, reference is made to the following detailed description of a representative embodiment taken in conjunction with the accompanying drawings, in which.

DETAILED DESCRIPTION OF THE PREFERRED EMBODIMENT

The present invention is directed to a customized digital listing system (CUDLS) which can be utilized as a wearable hearing aid and will be hereinafter referred to as the walkman unit. It is noted that the CUDLS could also be implemented as a desktop version of the walkman unit designed to be plugged in to a personal computer controlled by an audiologist or other similarly trained individual. This desktop version of the CUDLS is used by the audiologist to customize the walkman unit for each user.

Figure 1:
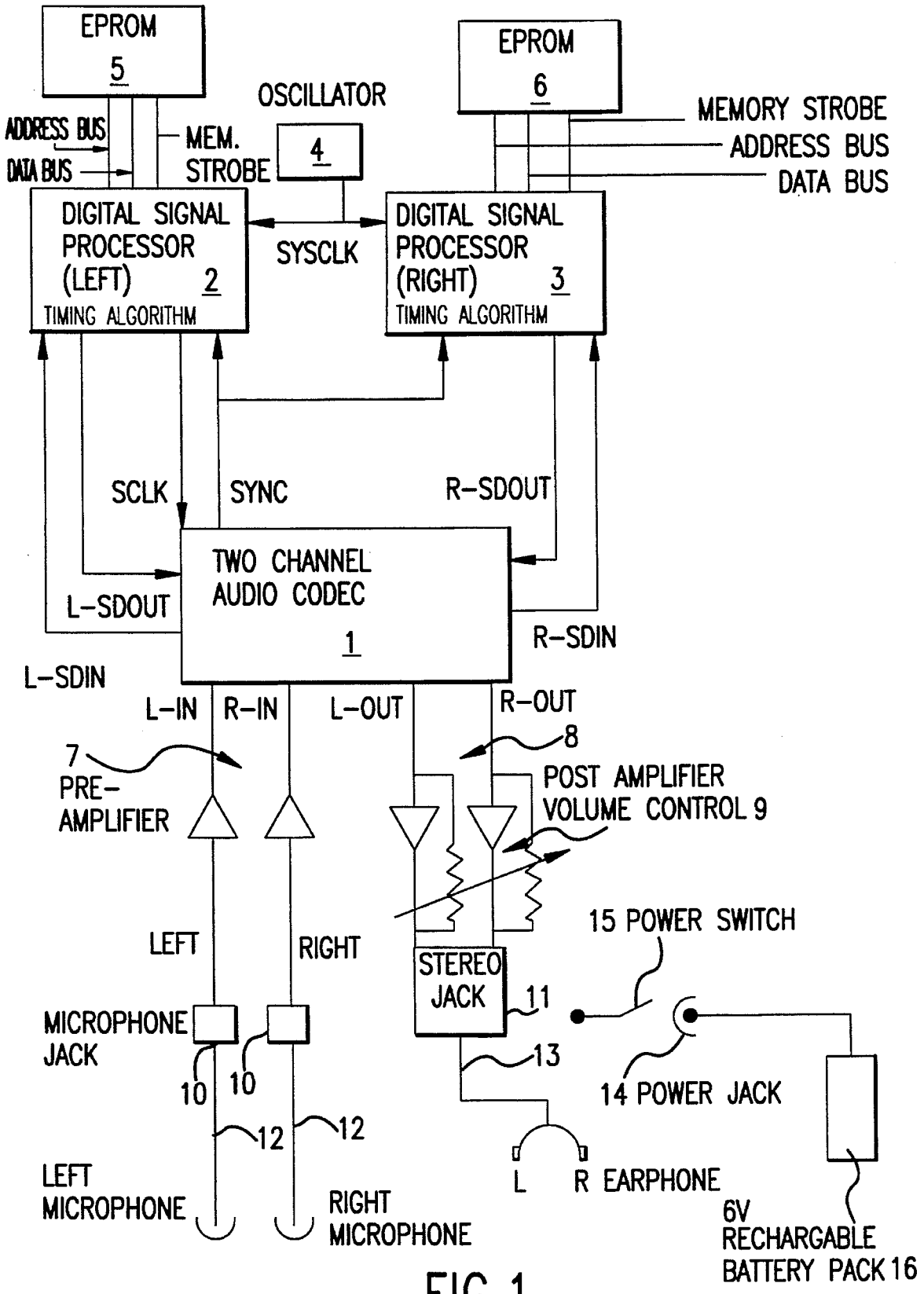
FIG. 1 is a system block diagram of the programmable digital heating aid.

FIG. 1 shows a system block diagram of the walkman programmable digital heating unit which contains two high speed digital signal processors 2 and 3, a clock oscillator 4 connected to both of the digital signal processors as well as two EPROMs 5, 6, each of which are also connected to a single digital signal processor. However, it should be noted that although the present invention utilizes two digital signal processors as well as two EPROMs, it is contemplated that a single digital processor as well as a single EPROM can also be employed to provide binaural phonetic speech. Although the specific digital signal processor which is employed is not crucial to the present invention, it has been found that the use of Texas Instruments' TMS320C3X digital signal processing chip operates very efficiently. The digital signal processor or processors are designed to be programmed by the audiologist after the individual user has been tested by downloading the program information into the EPROMs. This process of testing will be described subsequently in more detail.

The digital signal processing circuits (DSP) 2 and 3 operate at a clock speed of 33 million cycles per second. Each DSP executes the aforementioned multi-band digital filtering program customized for each ear at a rate of over 16 million 32-byte word instructions per second. The oscillator 4 provides the system clock SYSCLK to each of the DSP at the clock frequency of 33 million cycles per second. A two channel audio codec 1 is connected to the DSP and consists of two 16-byte analog-to-digital converters (A/D) and two 16-byte digital-to-analog converters (D/A). The A/Ds sample an input signal which is produced by left and right microphones connected to respective microphone jacks 10 via cables 12. These signals are transmitted to the codec 1 after passing through pre-amplifiers 7. The A/Ds sample the input signal L-N and R-N from the output of the pre-amplifiers 7 at the rate of 20,000 samples per second each. The signal is then convened into 16-byte linear value words and are output as two serial byte streams L-SDIN and R-SDIN. These signals are fed to DSP2 and DSP3, respectively. These digital words are conditioned utilizing the various filters provided in each DSP. These conditioned digital signals are then converted into analog signals in the codec 1 and are output to post-amplifiers 8 via L-OUT and R-OUT. These signals are conducted to a stereo jack 11 which in turn transmits the signals to an earphone 13 worn by the user. The user can adjust the volume of the audio signals by turning a knob attached to volume control 9. The programmable digital hearing aid is powered by a six volt rechargeable battery pack 16 connected to a power jack 14. An on/off switch 15 is also included.

When power is applied to the hearing aid through the on/off switch 15, each of the DSPs loads the program contained in its corresponding EPROMs 5 and 6 into its internal memory. During the loading process, the memory strobe, address bus and dam bus signals between each DSP and its corresponding EPROM are active. After the loading is completed, within a few milliseconds, these signals are in an inactive state. Each DSP then starts executing the frequency compensation filter program which is included in its internal memory. For example, the program in DSP2 initializes its timing generator to produce a clock signal SCLK that is connected to the audio codec 1 as the master serial shift clock for its internal control. When the codec 1 completes the analog-to-digital conversion, it alerts the DSPs via a SYNC signal approximately every 50 microseconds which corresponds to 20,000 samples per second. The SYNC signal causes each DSP to begin shifting in the 16-byte input sample value via the L-SDIN and R-SDIN serial inputs, and to start shifting out the processed value from the filtering program via the L-SDOUT and R-SDOUT serial outputs to the codec 1. Each DSP is interrupted internally when the 16-byte word and its serial input is received in the input register. The DSP then executes the filtering and frequency shaping program loop with this input sample value. The output of the program loop is stored at an output register provided in each DSP, ready to be output serially via its serial output upon the SYNC signal. The program loop is executed each time the input sample is received at the rate of 20,000 samples per second.

Each of the DSPs are programmed permitting either of the channels (right or left) to be switched off for a fraction of a selected time interval. However, both channels should not be switched off simultaneously. This feature is included to prevent fatiguing the eardrum with constant amplification.

Figure 2:
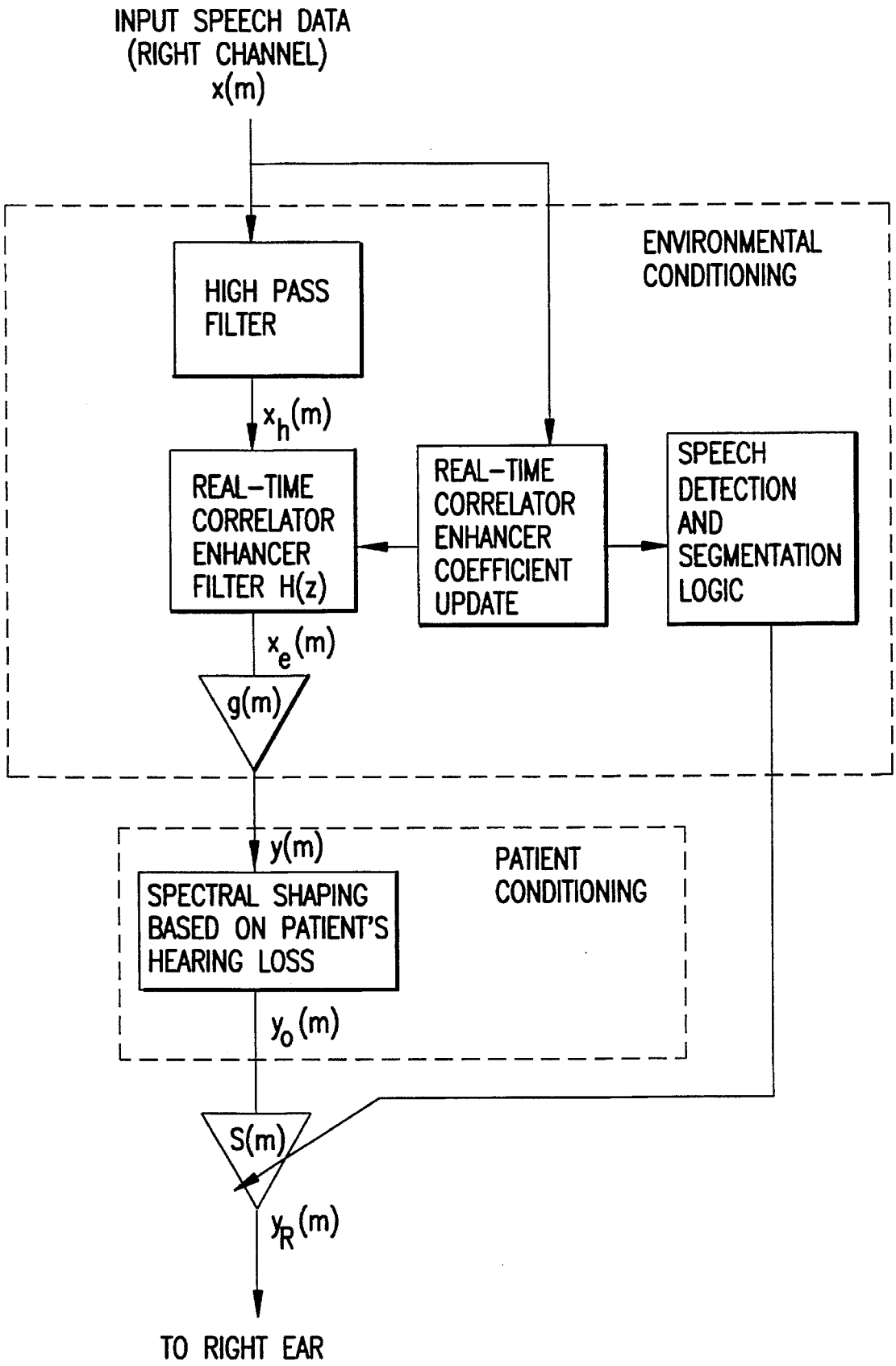
FIG. 2 is a block diagram of the required signal processing algorithm including environmental conditioning and patient conditioning.
Figure 7:
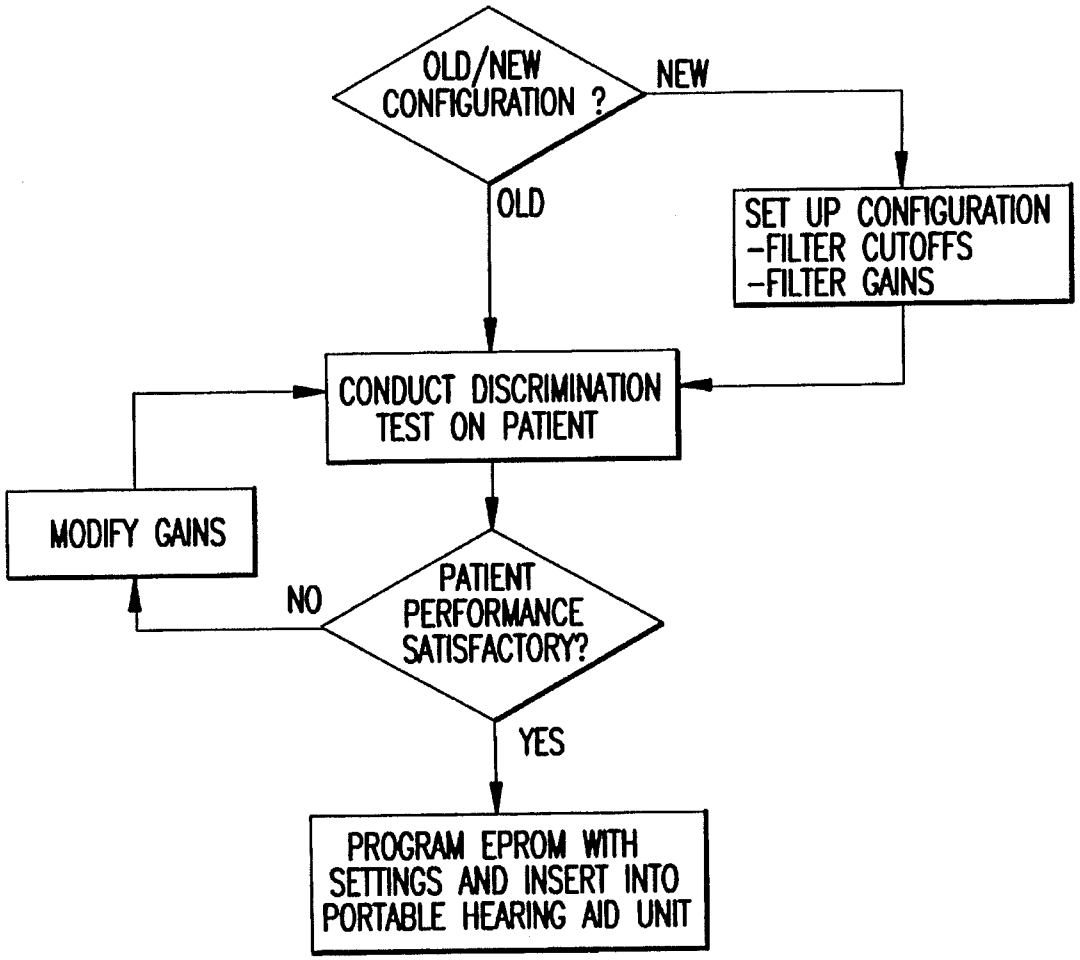
FIG. 7 illustrates a flow chart of the testing procedure.
Figure 8:
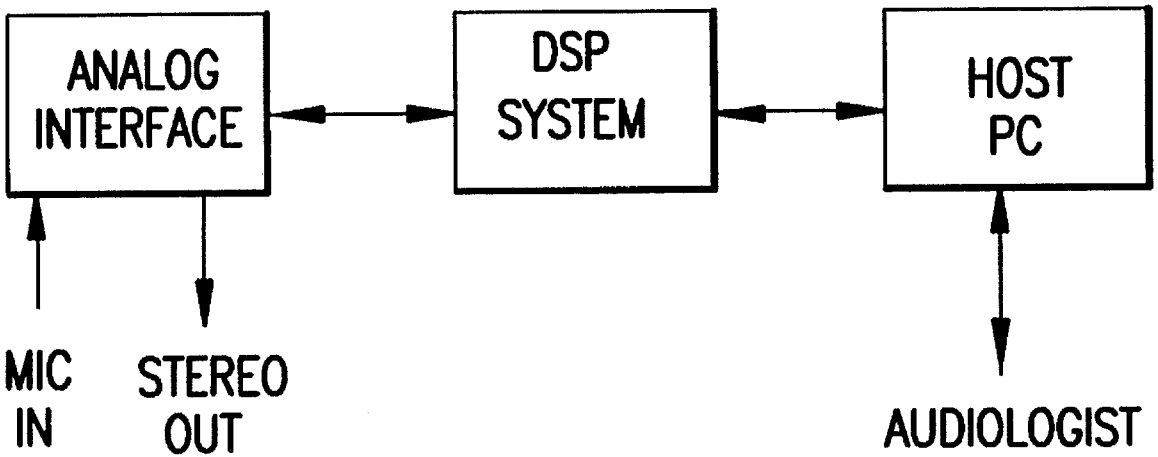
FIG. 8 illustrates a block diagram of the testing procedure.

FIG. 2 illustrates a block diagram showing the required signal processing algorithm which is employed in the present invention. This algorithm conditions the input signal based upon environmental circumstances (quiet or noisy background) and the hearing impaired person's hearing loss characteristic (patient conditioning). FIG. 7 illustrates a flow chart which an audiologist would utilize to test the individual user utilizing the equipment shown in FIG. 8. The user is provided with an analog interface including an input microphone as well as a stereo output set of earphones. This analog interface is connected to the desktop DSP system described above which is controlled by an audiologist through a host personal computer provided with input and output controls.

Utilizing this invention, the audiologist can run input speech data through the binaural equalization circuit contained in the desktop DSP. The equalization circuit is capable of sampling up to two input speech channels at a variable sampling rate. This circuit implements two banks of bandpass filters for each channel (ear). Based upon the responses elicited by the audiologist of the user, the audiologist would then choose the number of filters which would be implemented, the bandwidth of each filter as well as the particular gain, cut-off frequency, choice of center frequencies, and sidelobe characteristics of the filters. The host PC would include a visual display of each of the filters, and through any standard input device, such as a keyboard, the characteristics of each of the filters employed would be set and then loaded into the appropriate EPROM or EPROMs.

It has been determined that finite impulse response (FIR) filters are one type of filter which can be utilized in the DSPs. The design characteristics of these filters are as follows:

DEFINE NORMALIZED FREQUENCY $$v=\int(Hz)/\text{Nyquist}(Hz)$$

DEFINE FILTER SIZE AND CUTOFF FREQUENCIES filter size=2Q+1 lower cutoff=$v_L$ upper cutoff=$v_U$

COMPLETE COEFFICIENTS $$\text{i) } C_a = \int_{v_L}^{v_U} \cos(n\pi v)dv \quad |n| \leqq /Q$$

ii) window coefficients: $w_a|n| \leqq Q$ iii) windowed coefficients: $c_a = c_a w_a$

IMPLEMENT FILTER TRANSFER FUNCTION $$a_i = c_{q=} i=0, \ldots 2Q$$

$$H(z) = \sum_{i=o}^{i=2Q} a_i z^{-i}$$

Figure 6:
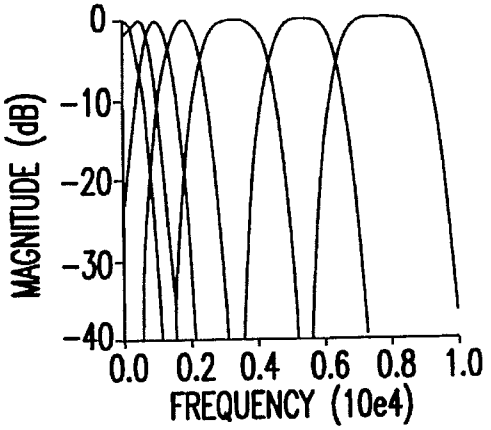
FIG. 6 shows a filter magnitude response.

FIG. 6 shows a measured magnitude response of one of the filter banks. This figure illustrates the results utilizing a filter bank consisting of seven filters. However, as indicated hereinabove, any number of filters can be employed.

Figure 3:
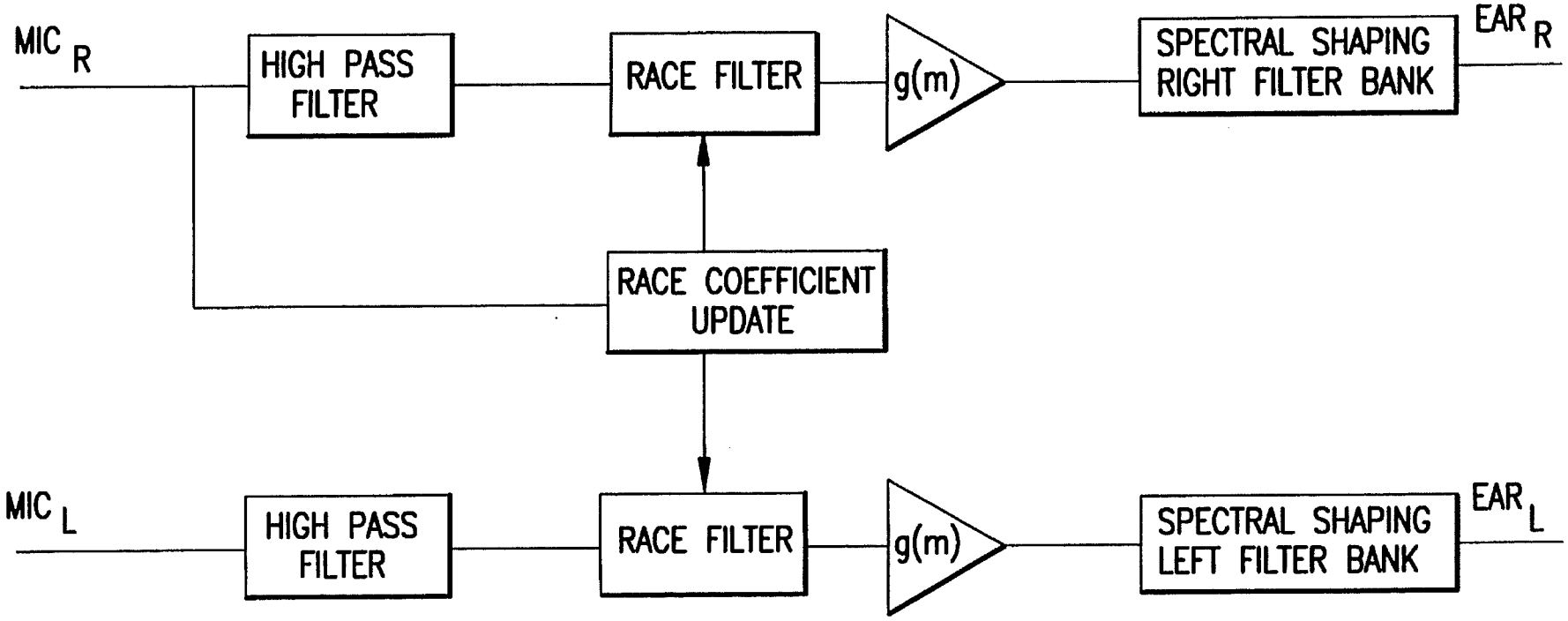
FIG. 3 is a block diagram of the required signal processing algorithm applied to two channels.

As shown in FIG. 1, the signal enhancement algorithm used in CUDLS has been designed to work with just one input data channel since the use of multiple microphones to permit effective beam forming was cumbersome, although that several microphones could have been used as shown in FIG. 3. Contrary to the patient conditioning algorithm in which the parameters of each of the digital filters are not altered once they are loaded into the EPROMs, the environmental conditioning algorithm is designed to filter out environmental or background noise in real time based upon this type of noise received by the CUDLS.

Initially, the audio input signal is first high pass filtered to compensate for low frequency spectral tilt in speech signals. This filter is a simple first order infinite impulse response (IIR) filter with tunable cut-off frequency.

The core of the environmental conditioning block is the real-time adaptive correlation enhancer (RACE) algorithm. RACE is essentially an adaptive finite impulse response (FIR) filter.

As shown in FIG. 2, the speech input (without being highpass filtered) is used to update the RACE coefficients. These coefficient consist of the estimated autocorrelation coefficients ($\hat{R}_{xx}(m,l)$ of the input channel. The autocorrelation coefficients are updated using a recursive estimator as given by the following equation:

$$\hat{R}_{xx}(m,l) = (\beta \hat{R}_{cc}(m-1,l) + (1-\beta) \times (m) \times (m=1) \tag{1}$$

where m: time index l: lag index $|l| \leqq L$

L: maximum lag value $\beta$: smoothing constant ($0 << \beta < 1$)

Equation (1) represents a recursive estimator which corresponds to sliding an exponential window over the data with a time constant ($\tau$ in seconds) given by $\tau = 1/((1-\beta)f_s)$ where $f_s$ represents the sampling frequency (sps).

The Z-transform of the adaptive filter can then be expressed as $$H(z) = a_o(m) + a_1(m)z^{-1} \ldots + a_{2L}(m)z^{-2L} \tag{2a}$$

where $$a_i(m) = \hat{R}_{xx}(m, L-i) i=0,1, \ldots 2L \tag{2b}$$

The input channel is then filtered using H(z) to obtain the enhanced output$x_e$ (m) as shown in FIG. 2. We have shown that for a narrowband signal, the amplitude gain and signal-to-noise (SNR) gain are both equal to approximately half the filter length or L. In terms of convergence considerations we have shown that RACE is able to converge rapidly enough so that the short term stationarity of the speech signal does not cause any problems for the algorithm. We have also shown that RACE is able to converge faster than the normalized LMS algorithm used for FIR and lattice adaptive filters.

A critical issue to ensure optimal performance for RACE is gain control. This is achieved by the gain parameter g(m) shown in FIG. 2. The algorithm offers the following choices for g(m):

$$\text{1) } g(m) = 1/(L\sigma_x^2(m))$$

$$\text{2) } g(m) = \sqrt{\sigma_{xh}^2(m)/\sigma_{xe}^2(m)}$$

The variances defined above are also estimated via the recursive equation:

$$\hat{\sigma}_z^2(m) = \beta\hat{\sigma}_z^2(m-1) + (1-\beta)z^2(m) \tag{3}$$

where z(m) is set appropriately to x(m), $x_h$(m) or $x_e$(m) . The program implementing the algorithm also applies some control logic that alternatively sets g(m) as per the choice made (1 or 2 above) or to unity. However, it should be noted that other choices can be made for g(m).

To selectively segment the incoming speech data, we first need to detect the presence of intelligible speech. To this end, the enhanced data is used to provide a measure of correlated energy in the data. We have shown that from the point of view of detecting low signal-to-noise ratio signals it is preferable to use the detection parameter described in what follows. The detection parameter is based on the estimated autocorrelation coefficients ($\hat{R}_{xx}(m,l)$) of the input channel (x(m)) obtained via equation (1).

The detection parameter (d(m)) is defined as, $$d(m) = \sum_{l=-L}^{L} \hat{R}_{xx}^2(m,l);\ l \neq 0 \tag{4}$$

In the equation above, the center lag coefficient is omitted to improve the detectors ability to detect low SNR signals while keeping false alarms to a minimum.

The signal d(m) is passed through a sliding window detector implemented via the following three equations:

$$w_1(m) = \beta_1 * w_1(m-1) + (1-\beta_1) * d(m) \tag{5a}$$

$$w_2(m) = \beta_2 * w_2(m-1) + (1-\beta_2) * d(m-\Delta) \tag{5b}$$

$$t(m) = w_1(m) - k_h * w_2(m) > 0.0 \tag{5c}$$

In the equations above, $\beta_1$ and $\beta_2$ are chosen so that $w_1$(m) represents a short-time average of d(m) and $w_2$ (m) represents a delayed long-time average of d(m). The constant $k_h$ represents a threshold setting parameter. The signal t(m) results from the comparison of $w_1(m)$ with its past history represented by $w_2$ (m) to look for a sudden increase in the correlated energy level in the input signal t(m), indicating the presence of intelligible speech.

Utilizing t(m), appropriate control logic is then applied to the output of the patient conditioning block $y_o(m)$ to selectively segment it so that the enhanced and spectrally modified speech output ($y_R(m)$) exists only when intelligible speech is present regardless of whether the background is quiet or noisy.

Figure 4:
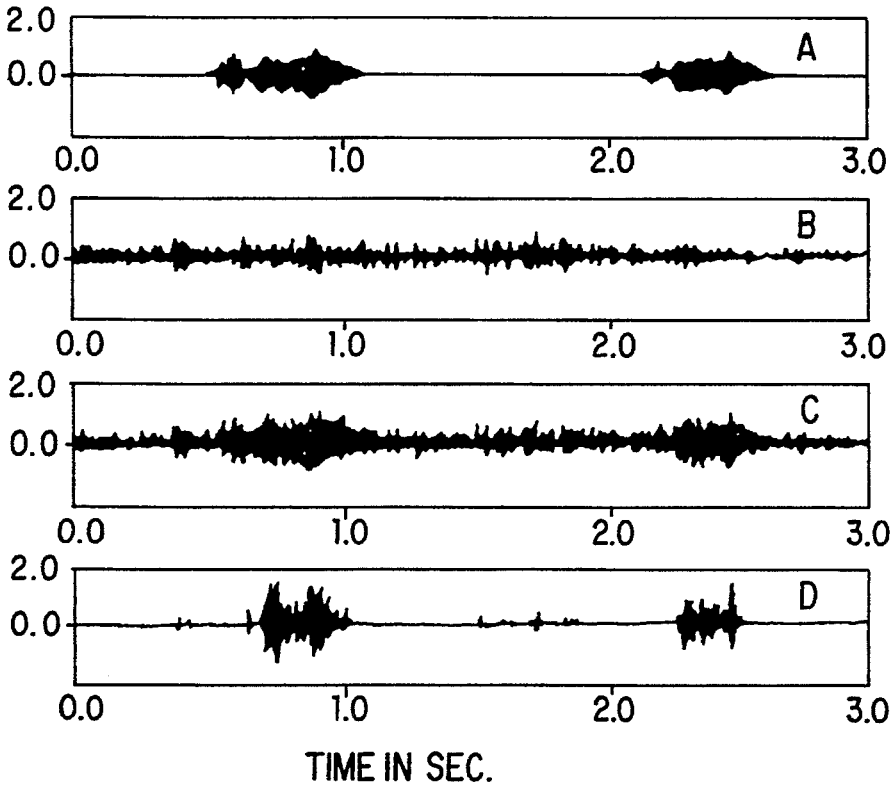
FIG. 4 shows a graph representing a spoken word and noise over a particular time domain.
Figure 5:
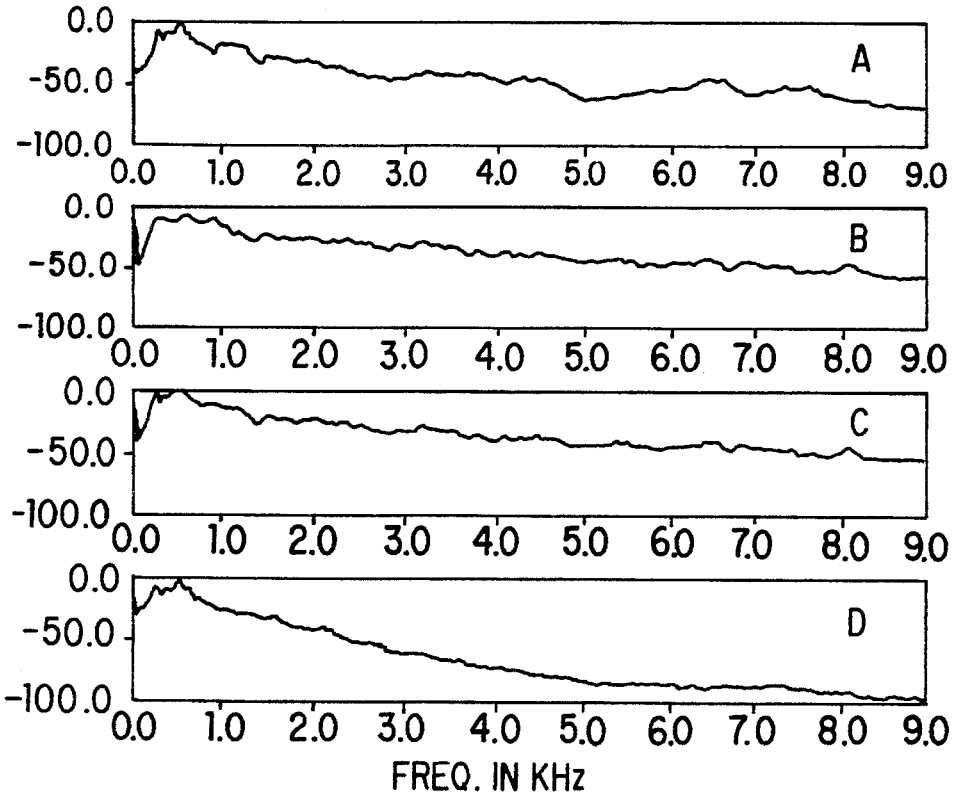
FIG. 5 is a graph of the spectral density of the traces shown in FIG. 4 in a frequency domain.

FIGS. 4 and 5 show some data plots illustrating results obtained by utilizing the configuration shown in FIG. 3 with a sampling frequency of 18 KHz. The line denoted as A is FIG. 4 represents the word "zero" spoken twice and trace B represents recorded cafeteria noise. Trace C represents the sum of traces A and B. The SNR for the first "zero" was 6 dB and 4 dB for the second "zero". Trace, D represents the output of RACE with the HPF cutoff at d.c. and g(m)=unity. FIG. 5 shows the spectral density plots for the second "zero" in the corresponding traces shown in FIG. 4. These spectra were obtained by using 20 ms of data centered 2.4 s into the data files. It is noted that there is a marked reduction in a noise floor in comparing traces C and D of FIG. 5.

The CUDLS according to the present invention has been able to increase the discrimination scores of severely to profoundly deaf patients by up to 30%. In real life situations, patients have been able to converse normally even in extremely noisy environments. Furthermore, many of the profoundly deaf patients were able to hear high frequency sounds for the first time and were able to repeat these sounds back to the audiologist.

It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A binaural programmable digital hearing aid customized for a particular user comprising:

a) input means for sensing input analog audio signals, said input means including a first right microphone directed to the right side of the particular user and a second left microphone directed to the left side of the particular user;

b) audio codec connected to said input means for converting said analog signals into digital words;

c) at least one programmable digital signal processor connected to said audio codec for shaping the speech spectrum of said input analog signals by manipulating said digital words according to a customized filter algorithm programmed into said at least one digital signal processor to create a variable number of finite impulse response filters based upon responses initially elicited from the particular user, said algorithm enabling said at least one digital signal processor to divide a 9 KHz frequency band of said input analog signals into a variable number of discrete frequency bands based upon the hearing loss of the particular user and to set the gain of each of said variable number of discrete frequency bands also based upon the hearing loss of the particular user, as well as to vary the upper and lower cut-offs of each discrete frequency band also based upon the hearing loss of the particular user;

d) at least one programmable read only memory connected to said at least one programmable digital signal processor for inputting said customized filter algorithm to said at least one programmable digital signal processor based upon responses initially elicited from the particular user;

e) digital-to-analog converter provided in said audio codec for converting said manipulated digital words to output analog audio signals; and f) output means connected to said audio codec for transmitting said output analog signals to the particular user, said output means including a first channel directed to the right ear of the particular user and a second channel directed to the left ear of the particular user.

2. The programmable digital hearing aid in accordance with claim 1, further including a rechargeable battery pack for powering the heating aid.

3. The programmable digital hearing aid in accordance with claim 1 further including an adaptive filter provided in said at least one digital signal processor for eliminating background noise included in said input analog audio signals.

4. The programmable digital heating aid in accordance with claim 1, further including a timing algorithm provided in said at least one digital signal processor for switching off said output analog signals transmitted to either said first or second channels for a selected time interval.

5. The programmable digital hearing aid in accordance with claim 1, wherein said variable number of finite impulse filters is equal to said variable number of said discrete frequency bands for the particular user.

6. The programmable digital hearing aid in accordance with claim 1, wherein the at least five finite impulse response filters created is at least five.

7. A programmable digital hearing aid customized for a particular user comprising:

a) input means for sensing input analog audio signals;

b) audio codec connected to said input means for converting said analog signals into digital words;

c) at least one programmable digital signal processor connected to said audio codec for shaping the speech spectrum of said input analog signals by manipulating said digital words according to a customized filter algorithm programmed into said at least one digital signal process to create a variable number of finite impulse response filters based upon responses initially elicited from the particular user, said algorithm enabling said at least one digital signal processor to divide the frequency band of said input analog signals into a variable number of discrete frequency bands based upon the hearing loss of the particular user and to set the gain of each of said variable number of discrete frequency bands also based upon the hearing loss of the particular user;

d) at least one programmable read only memory connected to said at least one programmable digital signal processor for entirely inputting said customized filter algorithm to said at least one programmable digital signal processor based upon responses initially elicited from the particular user;

e) digital-to-analog converter provided in said audio codec for converting said manipulated digital words to output analog audio signals;

f) output means connected to said audio codec for transmitting said output analog signals to the particular user; and g) a rechargeable battery pack for powering the hearing aid.

8. The programmable digital hearing and in accordance with claim 7 wherein the frequency band of said input analog signals is between 0 and 9 KHz.

9. The programmable digital hearing aid in accordance with claim 7 further including an adaptive filter provided in said at least one digital signal processor for eliminating background noise included in said input analog audio signals.

10. The programmable digital hearing aid in accordance with claim 7, wherein said output means is provided with first and second channels.

11. The programmable digital hearing aid in accordance with claim 10, further including a timing algorithm provided in said at least one digital signal processor for switching off said output analog signals transmitted to either first or second channels for a selected time interval.

12. The programmable digital hearing aid in accordance with claim 7, wherein the variable number of finite impulse response filters created is at least four.

13. The programmable digital hearing aid in accordance with claim 7, wherein said variable number of finite impulse filters is equal to said variable number of said discrete frequency bands for the particular user.

14. The programmable digital hearing aid in accordance with claim 7, wherein the at least five finite impulse response filters created is at least five.

* * * * *